United States Patent [19]

Hirayama

[11] 4,237,804

[45] Dec. 9, 1980

[54] LOOPER CHANGEOVER DEVICE FOR AN EDGE STITCHING SEWING MACHINE

[75] Inventor: Tetsuro Hirayama, Chofu, Japan

[73] Assignee: Juki Co., Ltd., Tokyo, Japan

[21] Appl. No.: 920,492

[22] Filed: Jun. 29, 1978

[30] Foreign Application Priority Data

Aug. 2, 1977 [JP] Japan ..... 52/92821
Feb. 28, 1978 [JP] Japan ..... 53/22423

[51] Int. Cl.[3] ..... D05B 1/08; D05B 1/20; D05B 57/06

[52] U.S. Cl. ..... 112/168; 112/162; 112/199

[58] Field of Search ..... 112/269.1, 162, 168, 112/199, 268, 177, 159, 160

[56] References Cited

U.S. PATENT DOCUMENTS

| | | | |
|---|---|---|---|
| 967,804 | 8/1910 | Merritt et al. | 112/162 |
| 1,864,393 | 6/1932 | Zeier et al. | 112/162 |
| 1,929,323 | 10/1933 | Maier | 112/199 |
| 3,121,413 | 2/1964 | Sigoda | 112/162 X |
| 3,373,706 | 3/1968 | Armstead, Jr. | 112/269 X |
| 3,395,660 | 8/1968 | Lewis, Jr. et al. | 112/162 |
| 3,753,410 | 8/1973 | Kostenowczyk | 112/168 |
| 3,885,509 | 5/1975 | Cox | 112/269 X |

*Primary Examiner*—Werner H. Schroeder
*Assistant Examiner*—Andrew M. Falik
*Attorney, Agent, or Firm*—Irving M. Weiner; Pamela S. Burt; John L. Shortley

[57] ABSTRACT

The tip end of the upper looper of an edge stitching sewing machine is adapted to have a different profile by engagement with a pawled looper arm provided on the upper looper itself or on a mounting post of the upper looper. When the pawled looper arm is engaged with the upper looper, the sewing machine performs one-needle two-thread edge stitching, while it performs its original one-needle three-thread edge stitching when the pawled looper arm is detached from the upper looper in a disengaged position.

9 Claims, 14 Drawing Figures

LOOPER CHANGEOVER DEVICE FOR AN EDGE STITCHING SEWING MACHINE

BACKGROUND OF THE INVENTION

1. Field of the Invention

The present invention relates to a changeover device incorporated in a looper arm mechanism of an edge stitching sewing machine. More particularly, the invention relates to a device which enables the user to perform one-needle two-thread edge stitching by using a sewing machine primarily applicable for one-needle three-thread edge stitching work. Such two types of edge stitching can be selectively performed by a sewing machine by means of a one-touch changeover device incorporated in the looper mechanism.

2. Description of Relevant Art

When it is necessary to perform one-needle two-thread edge stitching by using a conventional sewing machine of the one-needle three-thread edge stitching type, it has been necessary to disassemble an upper looper and replace it with a hook looper, as well as to replace other associated parts such as a thread guide and the like. Such changeover work is not only troublesome, but requires considerable skill which is quite difficult for an operator employed for ordinary sewing work.

Accordingly, it has been a known practice to separately provide two types of sewing machines, one for one-needle three-thread edge stitching work, and the other for one-needle two-thread edge stitching. However, such separate provision of two different types of sewing machines having substantially the same construction, except for different looper mechanisms, has been found to be uneconomical and objectionable with regard to work efficiency and effective use and adjustment of the floor space to be used in a shop.

Accordingly, there has developed a great need for a novel sewing machine which is capable of performing both one-needle three-thread edge stitching and one-needle two-thread edge stitching by a mere one-touch changeover action.

SUMMARY OF THE INVENTION

In view of the various problems and drawbacks encountered in known sewing machines as explained above, the main object of the present invention is to provide a changeover device or mechanism for a looper mechanism which enables ready and selective changeover between one-needle three-thread edge stitching, and one-needle two-thread stitching.

Another object of the invention is to provide a novel looper changeover mechanism which comprises a pawled looper arm which includes a set of hook loopers employed when the pawled looper arm engages with the upper looper. Further, the pawled looper arm can be swingably shifted to a position in which it does not hinder or disturb sewing or stitching other than one-needle two-thread stitching.

A further object of the invention is to improve work efficiency of sewing work which necessitates two types of stitching. Further, the invention facilitates installation of sewing machines in a sewing shop or factory by enabling two types of stitching to be performed with a single stitching sewing machine.

According to the present invention, a sewing machine which is capable of one-needle three-thread edge stitching is further provided with a pawled looper arm tip end which is shaped to have a pawl. The pawled looper arm, together with an upper looper, comprises an assembled novel hook looper front edge for carrying out one-needle two-thread edge stitching when the forward portion of the pawled looper arm is engaged with the forward portion of an upper looper normally adapted for performing one-needle three-thread edge stitching work. The pawled looper arm is swingably mounted on a looper assembly for permitting it to move in a reciprocal cyclic motion integrally with the upper looper in a position in which it is engaged therewith, or a rest position when the pawled looper arm is turned about a shaft and is disengaged from the upper looper. The tip end of the pawled looper arm is shaped to form a pawl or hook having a jaw in front and capable of picking up a lower looper thread when the pawled looper arm is engaged with the upper looper.

More particularly, the tip end of the upper looper functions as a jaw, and the pawl-like portion, hereinafter referred to as a looper pawl, is disposed in an upstanding position behind the jaw to sustain the thread. When assembled, the front edge of the looper pawl and that of the upper looper together form a hook having an "L" shaped profile on which the lower looper thread is sustained. When the pawled looper arm is turned to swing away from the engaged position and is set at a disengaged or rest position, the upper looper is returned to its initial state as an upper looper for performing one-needle three-thread edge stitching.

The pawled looper arm is swingably mounted about a shaft on the looper assembly in such a manner that the arm may be moved integrally with the upper looper arm. The center of the shaft is disposed at a constant distance with respect to the upper looper, thus permitting mutual engagement of the two parts at any time and at any phase of the reciprocal cyclic motion of the upper looper arm.

From the foregoing, it will be understood that either one of the two ways of stitching, i.e., one-needle three-thread edge stitching or one-needle two-thread edge stitching, can selectively be changed-over or shifted merely by turning the pawled looper arm, which operation is easily performed by an operator of ordinary skill without necessitating any particular skill or experience.

Further, the present invention enables disengagement of the looper pawl arm so as to take a rest position by turning it away from the upper looper towards the rest position and fixing it by any suitable locking means such that the pawled looper arm at the rest position does not hinder or disturb any subsequent sewing work.

DETAILED DESCRIPTION OF PREFERRED EMBODIMENTS

Figure 1:
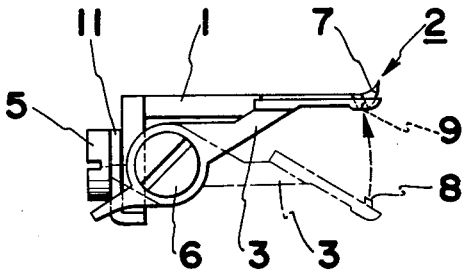
FIG. 1 is a plan view showing a looper assembly of a preferred embodiment of the invention wherein a pawled looper arm is horizontally swung for both engagement with and disengagement from the upper looper.
Figure 2:
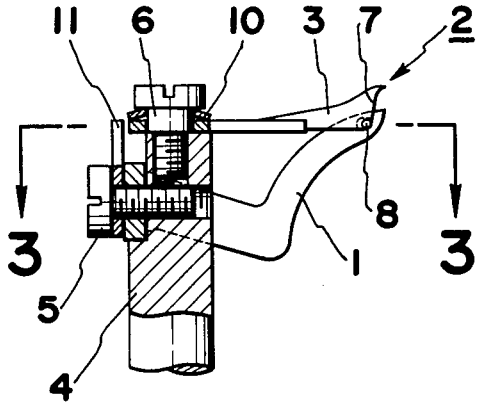
FIG. 2 is a partial sectional front view of the embodiment shown in FIG. 1.
Figure 3:
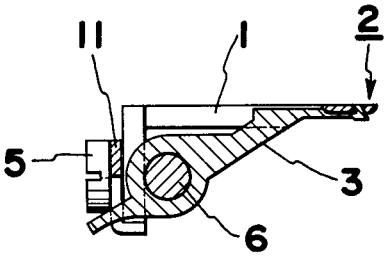
FIG. 3 is a sectional view taken along line 3—3 of FIG. 2.
Figure 4:
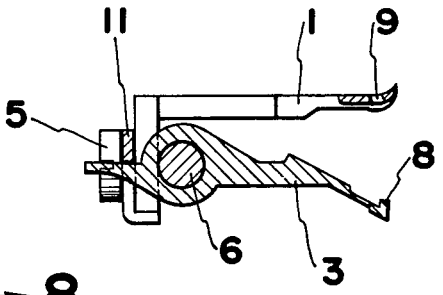
FIG. 4 is a sectional plan view showing the pawled looper arm of FIG. 3 in a disengaged position.

FIGS. 1 through 4 show a looper assembly of a sewing machine for performing one-needle two-thread edge stitching by using a conventional one-needle three-thread stitching (Japanese Industrial Standards Class B9070 Symbol E13. E13a) by a cooperative action of an upper looper and a lower looper (not shown), in accordance with the present invention. The sewing machine itself is well known, and a detailed description thereof is thus omitted herein.

An upper looper arm 1 is fixed to a mounting post 4 by a bolt 5, and the upper looper can be moved integrally with mounting post 4 so as to repeat a reciprocal cyclic motion following a predetermined locus. A pawled looper arm 3 which comprises a hook looper 2 when it is engaged with upper looper arm 1 is also swingably set by a bolt-shaped shaft 6 to the top end of mounting post 4.

Figure 12A:
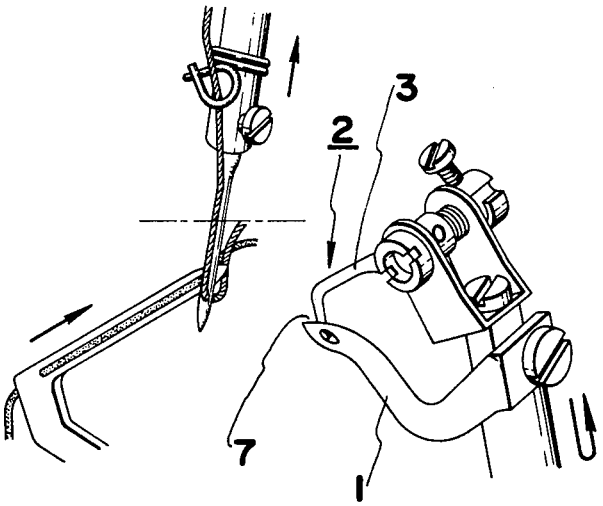
FIGS. 12A, 12B and 12C are perspective views of the looper mechanism showing the loop handling action thereof.
Figure 12B:
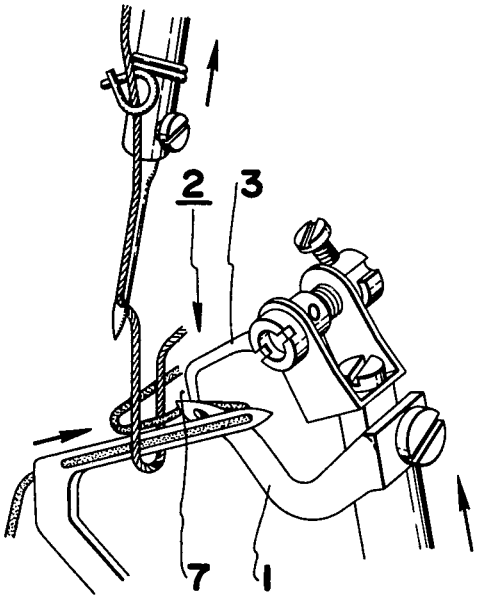
Figure 12C:
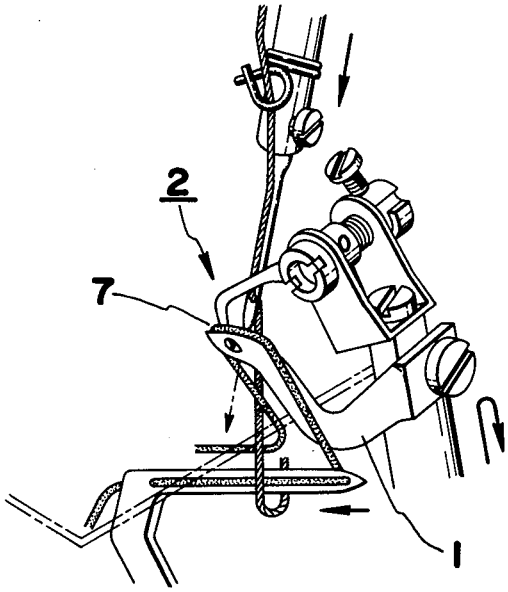

As shown in FIG. 12A, the hook looper 2 thus formed by mutual engagement of the two related parts described above includes, at its forward end or tip end, a hooked portion 7 formed by each forward top end of upper looper arm 1 and pawled looper arm 3. Hooked portion 7, as shown in FIG. 12B, takes up each successively formed loop of a lower looper thread formed by the lower looper and carries the thread loop to the upper face of a needle plate as shown in FIG. 12C where the needle carrying a needle thread descends along the dashed arrow line and thereby hooks the thread loop of the lower looper thread. Accordingly, these two threads entangle each other for enabling one-needle two-thread edge stitching [Japanese Industrial Standards (JIS) Class B9070 Symbol E12, E12A].

Upon retraction of hook looper 2 there remains no lower looper thread being taken up by hooked portion 7, i.e., hook looper 2 functions to take up and carry the lower looper thread at each cycle up to the upper surface of the needle plate such that the lower looper thread is grasped by the needle.

The pawled looper arm 3 has a projection 8 at its tip end, and projection 8 enters into a thread hole 9 of upper looper arm 1 when the two arms are engaged together. This manner of engagement is effective not only to prevent the lower looper thread from entering further beyond the thread hole whereby the thread is tightly pinched by the two arms and thus becomes incapable of escaping therefrom, but also serves to provide secured formation of the loop of the lower looper thread by hook looper 2. The projection 8 may be provided at another position so as to be engaged with a separately formed indentation or hole other than thread hole 9.

It is to be noted that, when upper looper arm 1 is engaged with pawled looper arm 3 so as to form hook looper 2 for carrying out one-needle two-thread stitching, an upper looper thread used for performing one-needle three-thread stitching is removed. When the two looper arms are engaged together, the tip end of upper looper arm 1 forms a lower jaw, and the tip end of pawled looper arm 3 forms a portion which upstands slightly behind the jaw and which has a profile similar to a tooth or a pawl. The two looper arms together form a continuous "L" shaped profile.

When setting the pawled looper arm 3 about the shank of bolt 6 having a stepped portion, a bevelled spring washer 10 is interposed between the head of bolt 6 and the upper surface of looper arm 3 so as to be fixed with suitable frictional contact, and pawled looper arm 3 can be turned about the shank of bolt 6 against the frictional contact. An alternative manner of fixing can also be employed.

The pawled looper arm 3 is turned or swung between two positions, in one of which there is formed an assembly as a hook looper arm 2, and in the other of which the pawled looper arm 3 is disengaged from upper looper arm 1 so as to permit upper looper arm 1 to act in its original function. A restraining member or stopper 11 is provided to restrain excessive overturn of looper arm 3 which may cause damage of upper looper arm 1 during operation.

Alternatively, the pawled looper arm may be biased by a spring toward its engaged position and is turned away from the engaged position against the resilient force exerted by the spring and is fixed by any suitable stopper means.

Turning or swivel motion of the pawled looper arm need not necessarily be in a right-angular direction relative to the axis of mounting post 4 if the turned looper arm placed at the rest position after having been disengaged does not hinder the movement of the relevant parts for performing subsequent sewing operations.

Although the pawled looper 3 is shown rotatably fixed to mounting post 4, it may alternatively be directly mounted on the upper looper arm itself.

As can be understood from the foregoing, one-needle two-thread edge stitching according to the present embodiment of the invention can readily be changed-over or shifted to one-needle three-thread edge stitching merely by turning pawled looper arm 3 away from engagement with upper looper arm 1 and passing an upper looper thread through thread hole 9. Similarly, changeover of the sewing machine from one-needle three-thread edge stitching to one-needle two-thread sewing can be made by engaging pawled looper arm 3 with upper looper arm 1 and removing the upper looper thread from the upper looper. Such simple and easy shifting can be performed by any operator of ordinary sewing skill.

FIGS. 5 through 9 show an upper looper mechanism of a second embodiment of the invention which is applicable for the same type of sewing machine as set forth above.

A pawled looper arm 3, which by engagement with an upper looper 1 constitutes at its forward tip end a hook looper 2, is pivotally supported at its base portion to a mounting yoke 13 which further is fixed to mounting post 4 by a bolt 12. This construction permits the pawled looper arm 3 to turn upwardly and downwardly.

The bolt shaft 6, which constitutes a swivel shaft, has provided at its one axial end an adjusting means such as an adjusting head 14 for adjustably turning pawled looper arm 3. The shank of bolt 6 is formed in a two-stepped shape, approximately the half axial length of which from the shank end has a smaller diameter and passes through and further projects outside of mounting yoke 13. A coil spring 16 is interposed between an upstanding piece 13*a* of mounting yoke 13 and a radial wall 15 of the stepped portion of the neck of bolt 6 for urging the bolt shaft toward its head portion 14*a*.

The mounting yoke 13 is provided with a pin 17 which passes through both of the two upstanding pieces of yoke 13 and is fixed parallel to bolt 6. One end portion of pin 17 projects outwardly beyond the wall of the upstanding piece 13*a* of mounting yoke 13.

A collar 19 is mounted around the projected end portion of the shank of bolt shaft 6 and is tightly fixed to the shaft by a set screw 18. The collar 19 engages with the protruded end portion of pin 17 and restrains the extent of the angle of turning of bolt 6. Recesses 20 and 21 are formed in collar 19 corresponding to the required angle of turning of bolt 6.

In this embodiment, bolt shaft 6 is constructed to be turned 90°, and recesses 20 and 21 are provided on an arcuate step 22 of collar 19 in such a manner that the two recesses constitute a circular angle of 90°.

Figure 5:
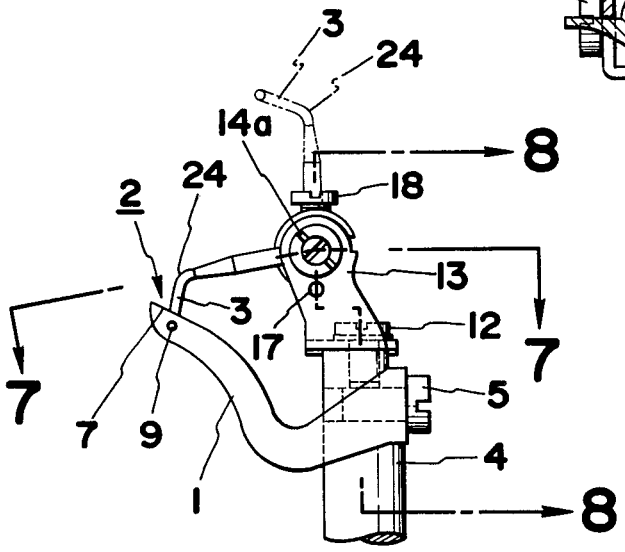
FIG. 5 is a front view showing another embodiment of the present invention wherein a pawled looper arm is swingable upwardly and downwardly for engagement with and detachment from the tip of an upper looper arm.
Figure 6:
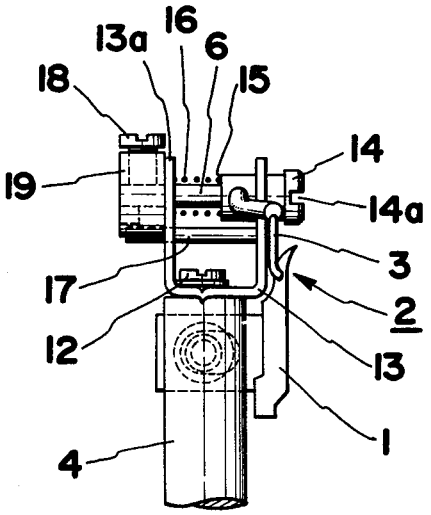
FIG. 6 is a left side elevational view of the looper assembly shown in FIG. 5.
Figure 7:
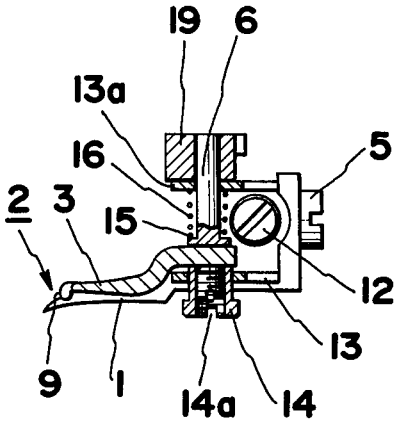
FIG. 7 is a sectional plan view taken along line 7—7 of FIG. 5.

Because bolt shaft 6 is urged by coil spring 16 towards head 14*a*, i.e., the adjusting means, the protruded tip end of pin 17 engages either one of recesses 20 and 21 in the engaged position shown in FIGS. 5–7.

The tip of pawled looper 3 has an outer diameter which is smaller than the inner diameter of a thread hole in upper looper arm 1 so that the tip of pawled looper 3 may be engaged in thread hole 9 when pawled looper 3 is turned toward upper looper 1. Such tip and hole engagement is effective to constitute a hook looper 2 having a reverse "L" shaped front profile as shown in FIG. 5.

The hooked looper arm 3 is bent at the portion indicated at 24, and the bent front part of pawled looper arm 3 and the tip of upper looper arm 1 constitute the hook looper 2 when they are disposed so as to engage with each other. The thus formed hook looper 2 takes up a loop of a lower looper thread formed by each successive rocking of the lower looper and guides the loop to the upper surface of the needle plate (not shown), and there the needle of the sewing machine passes through the loop to perform one-needle two-thread end stitching.

In this embodiment, a slot 14*a* is provided at the head 14 of bolt shaft 6, but any other means such as a head of a thumb screw may be employed, as long as it facilitates turning of bolt shaft 6. Also, a ridge and a groove are provided on mounting yoke 13 and on the top face of mounting post 4, respectively, to facilitate positioning.

When performing one-needle three-thread edge stitching, pawled looper 3 is turned about bolt shaft 6 to its disengaged position as shown by the dotted line in FIG. 5, and upper looper arm 1 thus disengaged is restored to act in its original capacity as an upper looper arm 1 for one-needle three-thread edge stitching.

When it is required to perform a one-needle two-thread edge stitching operation, the upper looper thread is removed from upper looper 1 and pawled looper arm 3 is turned such that its tip portion engages with thread hole 9 of upper looper arm 1 to constitute the hook looper assembly 2 composed of upper looper arm 1 and pawled looper arm 3.

The pawled looper arm 3 depicted in solid line in FIG. 5 is shown in an engaged position.

In this embodiment, the pawled looper arm 3 is constructed to be turned upwardly to assume a disengaged or rest position, but it is of course possible that it be alternatively turned downwardly to assume the rest position.

The pawled looper arm 3 is mounted on the top face of mounting post 4 after it has been mounted on mounting yoke 13, but alternatively it may be mounted on upper looper arm 1 itself or on other parts where pawled looper arm 3 follows, integrally with upper looper 1, the cyclic rocking motion of mounting post 4.

FIGS. 5 and 6 show the hook looper assembly 2 formed by engagement of upper looper arm 1 with pawled looper arm 3.

Figure 8:
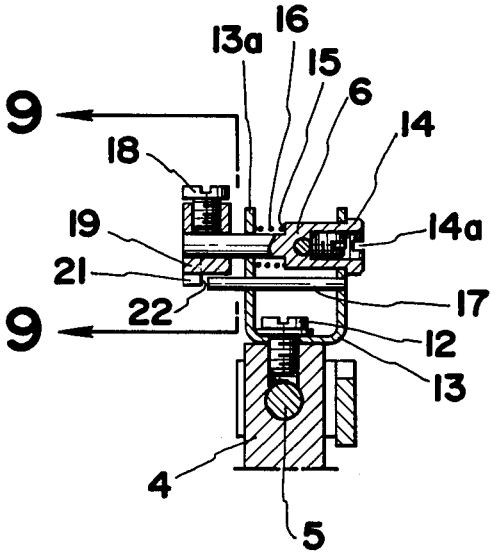
FIG. 8 is a sectional elevational view taken along line 8—8 of FIG. 5.
Figure 9:
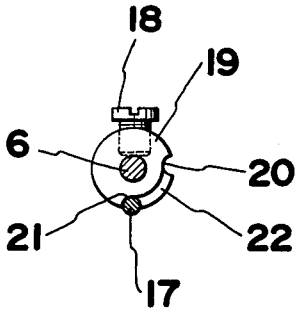
FIG. 9 is a sectional elevational view taken along line 9—9 of FIG. 8.

When it is necessary to turn pawled looper arm 3 to a disengaged or rest position, adjusting means or adjusting head 14 of bolt shaft 6 is pushed against the resilient force of coil spring 16 and is turned clockwise in FIG. 5. Upon pushing of bolt shaft 6 at its adjusting head 14, the entire part of bolt shaft 6 carrying pawled looper arm 3 proceeds in the direction of pushing, and the tip of pawled looper arm 3 is released from engagement with thread hole 9 of upper looper arm 1, and at the same time the tip of pin 17 is released from engagement with recess 21 of collar 19 as shown in FIG. 8.

Subsequent clockwise turning of bolt shaft 6 at a right angle will permit the end wall of stepped portion 22 to abut the tip of pin 17 to stop further turning. Then, the pushing on bolt 6 is released to permit coil spring 16 to urge the entire part of bolt shaft 6 to move in front of the surface of the paper in FIG. 5, i.e., to the right side of FIG. 6, and thus to revert to the original position before it has been pushed. Then, the tip of pin 17 is received by recess 20 of collar 19.

In this manner, pawled looper arm 3 is positioned and locked at its disengaged or rest position.

When it is required to form hook looper 2 by turning pawled looper arm 3 to engage with upper looper arm 1, bolt shaft 6 is pushed and turned counter-clockwise until it reaches the engaged position.

The head of the bolt or adjusting head 14 has a slot 14*a* for turning by a driver provided, for example, in the tool box of a sewing machine.

Figure 10:
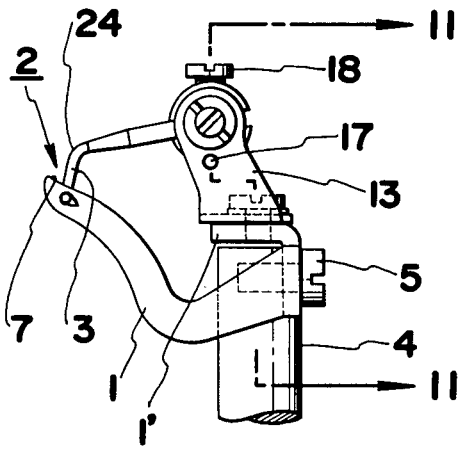
FIG. 10 is a front view showing another embodiment of the invention wherein a pawled looper arm is mounted on the upper looper arm and the tip thereof is swingable upwardly and downwardly for engagement with and detachment from the tip of the upper looper arm.
Figure 11:
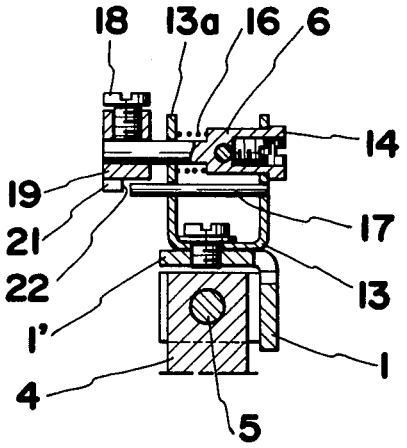
FIG. 11 is a sectional view taken along line 11—11 in FIG. 10.

As shown in FIGS. 10 and 11, the invention contemplates a further embodiment wherein a pawled looper arm 3 is pivotally supported at its base portion on a mounting yoke 13 and which further is fixed on the stem 1' which is a part of upper looper arm 1 and extends over the top end of mounting post 4 from the mounting base portion of upper looper arm 1. The upper looper arm is fixedly mounted on the side of mounting post 4 by bolt 5. In other respects, the structure is the same as the embodiment shown in FIGS. 5–9.

What is claimed is:

1. A looper changeover device for a sewing machine for one-needle three-thread edge stitching by a cooperative action of an upper looper and a lower looper which comprises:

an upper looper arm;

a pawled looper arm for forming a hook looper by engagement with said upper looper arm, said pawled looper arm being swingably mounted adjacent to, and acting integrally with, said upper looper arm for selective changeover between a disengaged position for one-needle three-thread edge stitching and an engaged position for one-needle two-thread edge stitching.

2. A looper changeover device for an edge stitching sewing machine according to claim 1, wherein:

said pawled looper arm is swivelled to swing in a horizontal direction for engagement with and detachment from the tip of said upper looper.

3. A looper changeover device for an edge stitching sewing machine according to claim 1, wherein:

said pawled looper arm is mounted adjacent said upper looper arm to move integrally with said upper looper arm and to be selectively swung upwardly and downwardly between the engaged position and the disengaged position disposed at a location upside or downside of the engaged position.

4. A looper changeover device for an edge stitching sewing machine according to claim 3, wherein:

said pawled looper arm is biased at its swivel shaft by a spring such that the tip of said pawled looper arm is urged against the thread hole of said upper looper arm;

a collar is fixedly mounted on an end part of a shaft;

said pawled looper arm being fixedly mounted on said shaft;

said collar includes a step extending in a predetermined circular angle and recesses defining both ends of said step;

a pin fixed on a portion other than said shaft, said pin projecting towards said step for engagement with said recesses; and whereby said collar is moved in an axial direction of said shaft by said spring and toward said pin for engagement therewith to maintain said pawled looper arm in an engaged position with said upper looper arm.

8. A looper changeover device for an edge stitching sewing machine according to claim 1, 5, 6 or 7, wherein:

said pawled looper arm is swingably mounted on a mounting post of said upper looper arm.

9. A looper changeover device for an edge stitching sewing machine according to claim 1, 5, 6 or 7, wherein:

said pawled looper arm is swingably mounted on said upper looper arm.

5. A looper changeover device for a sewing machine for one-needle three-thread edge stitching by a cooperative action of an upper looper and a lower looper which comprises:

an upper looper arm;

a pawled looper arm for forming a hook looper by engagement with said upper looper arm, said pawled looper arm being swingably mounted adjacent to, and acting integrally with, said upper looper arm for selective changeover between a disengaged position for one-needle three-thread edge stitching and an engaged position for one-needle two-thread edge stitching; and a projection for entering into a thread hole of said upper looper provided on the side front tip of said pawled looper arm to secure tight engagement of said pawled looper arm with said upper looper arm.

6. A looper changeover device for a sewing machine for one-needle three-thread edge stitching by a cooperative action of an upper looper and a lower looper which comprises:

an upper looper arm;

a pawled looper arm for forming a hook looper by engagement with said upper looper arm, said pawled looper arm being swingably mounted adjacent to, and acting integrally with, said upper looper arm for selective changeover between a disengaged position for one-needle three-thread edge stitching and an engaged position for one-needle three-thread edge stitching;

said pawled looper arm being mounted adjacent said upper looper arm to move integrally with said upper looper arm and to be selectively swung upwardly and downwardly between the engaged position and the disengaged position disposed at a location upside or downside of the engaged position; and said pawled looper arm being formed as a long bar of reduced diameter and being bent at its intermediate portion such that the tip thereof enters into a thread hole formed at the tip of said upper looper arm to secure tight engagement of said pawled looper arm with said upper looper arm.

7. A looper changeover device for a sewing machine for one-needle three-thread edge stitching by a cooperative action of an upper looper and a lower looper which comprises:

an upper looper arm;

a pawled looper arm for forming a hook looper by engagement with the upper looper arm, said pawled looper arm being swingably mounted adjacent to, and acting integrally with, said upper looper arm for selective changeover between disengaged position for one-needle three-thread edge stitching and an engaged position for one-needle two-thread edge stitching;

said pawled looper arm being mounted adjacent said upper looper arm to move integrally with said upper looper arm and to be selectively swung upwardly and downwardly between the engaged position and the disengaged position disposed at a location upside or downside of the engaged position; and said pawled looper arm being biased at its swivel point by a spring such that the tip of said pawled looper arm is urged against the thread hole of said upper looper arm.

* * * * *